United States Patent [19]

Queudray

[11] Patent Number: 4,667,273

[45] Date of Patent: May 19, 1987

[54] ELECTROLUMINESCENT PANEL AND METHOD FOR MANUFACTURING SAME

[75] Inventor: Pierre Queudray, Montreuche-Venoy, France

[73] Assignee: Vibrachoc, Cedex, France

[21] Appl. No.: 770,930

[22] Filed: Aug. 30, 1985

[30] Foreign Application Priority Data

Aug. 30, 1984 [FR] France ..... 84 13443

[51] Int. Cl.[4] ..... F21K 2/00

[52] U.S. Cl. ..... 362/34; 362/84

[58] Field of Search ..... 362/34, 84; 40/544; 113/463

[56] References Cited

U.S. PATENT DOCUMENTS

| | | | |
|---|---|---|---|
| 3,219,008 | 11/1965 | Harris et al. | 116/286 |
| 3,531,881 | 10/1970 | Carley | 40/544 |
| 3,545,110 | 12/1970 | Coolbaugh et al. | 40/544 |
| 3,621,595 | 11/1971 | Coolbaugh et al. | 40/544 |
| 3,670,067 | 6/1972 | Coolbaugh et al. | 40/544 |
| 3,676,943 | 7/1972 | Kidd, Jr. et al. | 40/544 |

FOREIGN PATENT DOCUMENTS

| | | | |
|---|---|---|---|
| 1205706 | 2/1960 | France | 40/544 |
| 2111580 | 6/1972 | France . | |
| 829588 | 3/1960 | United Kingdom . | |
| 1201092 | 8/1970 | United Kingdom | 40/544 |

*Primary Examiner*—E. Rollins Cross

*Attorney, Agent, or Firm*—Sughrue, Mion, Zinn, Macpeak & Seas

[57] ABSTRACT

The present invention relates to an electroluminescent panel (10), composed of an electroluminescent lamp (1) and two plates (2, 3) enclosing said lamp, one of which (2) generally is not required to transmit light and the other (3) which is provided with lighting elements, comprising at least one opening for the passage of an operating control (6, 8), wherein the active part of the electroluminescent lamp is tangential to the periphery of one or several openings. It also relates to a method of manufacture of such a panel, and for application for control and command panels (pilot cockpits, dashboards, synoptics, . . . ).

5 Claims, 2 Drawing Figures

ELECTROLUMINESCENT PANEL AND METHOD FOR MANUFACTURING SAME

The present invention relates to an electroluminescent panel composed of an electroluminescent lamp and two plates enclosing said lamp, one of which generally is not required to transmit light and the other which is provided with lighting elements, comprising at least one opening for the passage of an operating controls.

It also relates to a method for manufacturing such a panel.

Electroluminescent panels used, for example, in the production of control and command panels generally comprise an electroluminescent lamp inserted between two plates connected by gluing, one of which is generally impermeable to light but which can be arranged to transmit light at certain places, and the other comprising the elements which it is desired to light.

An electroluminescent lamp is composed of a layer of doped powder inserted between two electrodes connected to an alternating electrical source. One of the electrodes is transparent and the surface of the lamp thus becomes luminous through photon emission, giving a homogeneous light source without a hot point.

Recent developments in lamp manufacturing techniques have enabled so-called "rigid" lamps to be abandoned in favor of so-called "flexible" lamps, the powder being coated between two flexible electrodes which are connected on their periphery by heat-soldered encapsulation. The electroluminescent panels, which are used in particular in pilot cockpits, contain operating control members which pass through said panels, and therefore corresponding openings must be provided in the thickness of the panel.

In a known manner, the provision of openings on the two panels and on the electroluminescent lamp is carried out separately, and, in the case of the lamp, the openings require heatsoldered encapsulation on their periphery. This presents a disadvantage because the presence of this encapsulation has a harmful effect on the emission of light at the periphery of each opening. The lighting of the periphery of the operating control member which passes through such opening is not provided in an effective manner.

The object of the present invention is to overcome this disadvantage so as to provide effective lighting of the periphery of the operating control member.

The electroluminescent panel in accordance with the invention is characterized in that the active part of the electroluminescent lamp is tangential to the periphery of one or several openings.

Preferably, an opening contains an optical guide over the entire thickness of the panel, and said optical guide contains a chamfer to improve the lighting of the operating control member passing through an opening.

The method of manufacture in accordance with the invention consists of inserting a full electroluminescent lamp between two plates, and is characterized in that an opening is provided through the entire thickness of the panel.

An optical guide is then preferably placed in said opening.

By way of example and in reference to the attached drawings, the following is a description of an electroluminescent panel in accordance with the invention.

Figure 1:
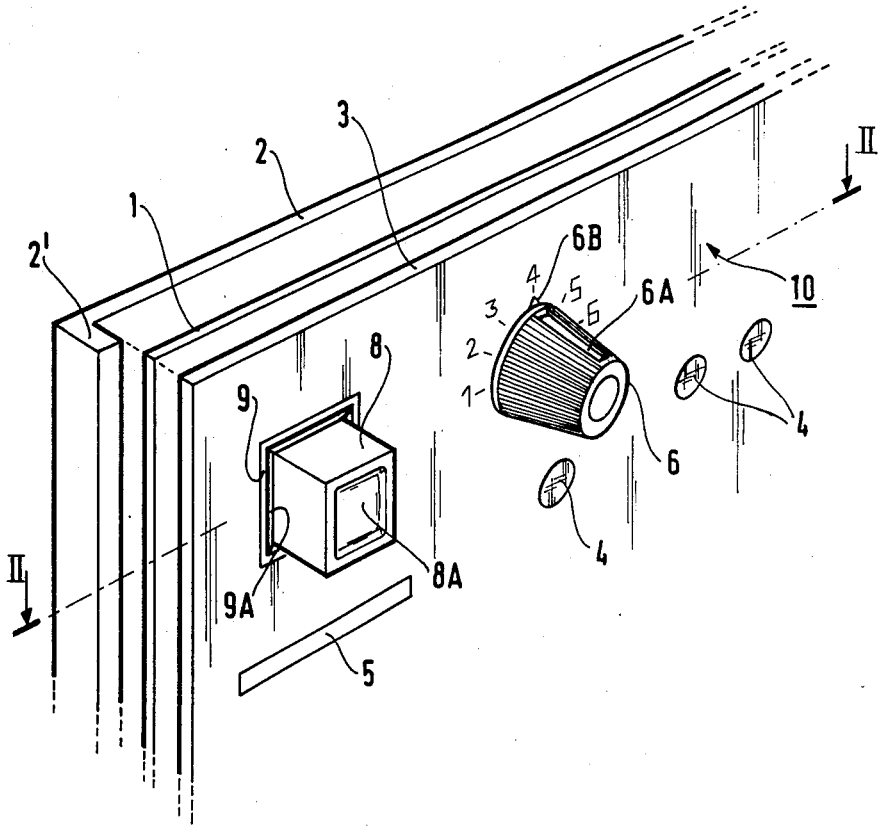
FIG. 1 represents an electroluminescent panel provided with two operating controls.

FIG. 1 shows a panel 10 containing a full electroluminescent lamp 1, inserted between two plates 2, 3. These plates can, for example, be manufactured in methacrylates or polycarbonates. Plate 2 constitutes a light-impermeable plate which has flanges 2' so as to receive lamp 1. Plate 3 is held in place by gluing flanges 2' of plate 2. Said plate 3 is the front plate which contains the lighting elements, such as, for example, luminous points 4 or a luminous strip 5 or even the luminous wording necessary to an operator responsible for, driving and control of any engine or machine. Two operating control members such as, for example, a turning button 6 and a push button 8 also pass through this plate.

Figure 2:
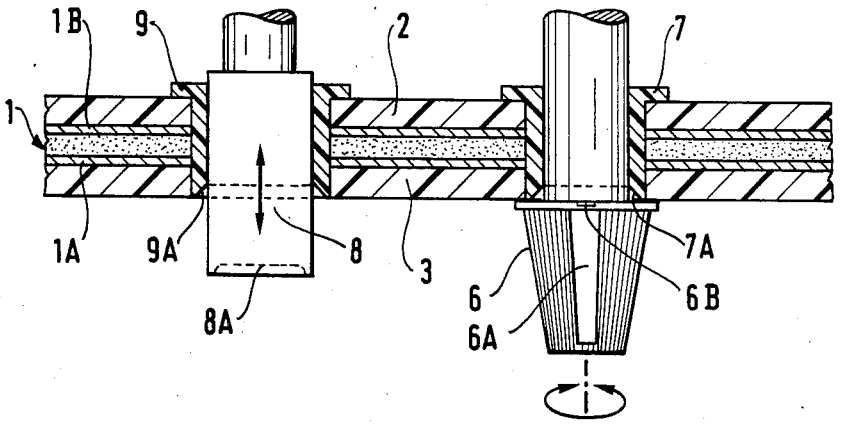
FIG. 2 represents the same panel in a cross-section along II of FIG. 1.

FIG. 2 shows, in cross-section, the crossing of buttons 6 and 8. This drawing represents lamp 1, which is composed of a powder inserted between two electrodes 1A, 1B, the two plates 2, 3 and buttons 6 and 8.

In order to avoid oxidation of the lamp due to humidity, an optical guide is placed in the openings provided for the buttons to pass through.

Optical guides 7 and 9 each contain a chamfer, 7A and 9A, respectively, so as to improve the lighting of each button.

By way of example, a control knob 6 and a push button 8 are shown.

Control knob 6 is provided with a notch 6A which allows the light emitted by the lamp to pass, said notch being extended by a projection 6B which is used to mark the graduation recorded on the panel.

The push button 8 has an aperture 8A which facilitates operation and the periphery of this button 8 is lit in a very clear manner because the active part of the electroluminescent lamp is tangential to the opening. The lighting of the periphery is further improved by the presence of the optical guide 9 provided with a chamfer 9A.

The operation which consists of producing the necessary opening for the buttons to pass through is carried out in the following manner:

- the panel is constituted by inserting the full lamp 1 between the two plates 2, 3 and this opening is bored with an appropriate tool (boring or milling tool), directly in the electroluminescent panel which is already prepared,
- the optical guide is then placed in the opening,
- all subsequent conventional operations, such as in particular, painting, marking or engraving, are then carried out in a known manner.

What is claimed is:

1. An electroluminescent panel (10), composed of an electroluminescent lamp (1) and two plates (2, 3) enclosing said lamp, one of which (2) generally is not required to transmit light and the other (3) which is provided with lighting elements, and comprising at least one opening extending completely through said panel, an operating control member (6, 8), positioned within said opening, the improvement comprising an active part of the electroluminescent panel (10) tangential to the periphery of said at least one opening for direct contact with the operating control member passing through said opening.

2. The electroluminescent panel of claim 1, wherein said control member mounts includes concentrically an optical guide (7, 9) said optical guide (7, 9) is sized to fit said panel opening and wherein said optical guide (7, 9)

is of length so as to extend axially over the entire thickness of the panel.

3. The electroluminescent panel of claim 2, wherein the optical guide (7, 9) comprises a chamfer (7A, 9A) to improve the lighting of the operating control member passing through said opening.

4. A method for manufacturing an electroluminescent panel (10) composed of an electroluminescent lamp (1) and two plates (2, 3) enclosing said lamp, one of which (2) generally is not required to transmit light and the other (3) which is provided with lighting elements, and comprising at least one opening for the passage of an operating control member (6, 8), and wherein said lamp has an active part, said method comprising the steps of:

inserting a full electroluminescent lamp (1) between two plates 92, 3), and providing an opening through the entire thickness of the panel including said lamp active part such that the exposed surface of the lamp active part directly contacts the operating control member when passed axially therethrough.

5. The method of claim 4, further comprising the step of placing an optical guide (7, 9) in the opening which receives said operating control member.

* * * * *